US009308566B2

(12) United States Patent
Ring et al.

(10) Patent No.: US 9,308,566 B2
(45) Date of Patent: Apr. 12, 2016

(54) COMPLIANT EXPANSION SWAGE

(71) Applicant: Weatherford/Lamb, Inc., Houston, TX (US)

(72) Inventors: Lev Ring, Houston, TX (US); Varadaraju Gandikota, Cypress, TX (US); Mike A. Luke, Houston, TX (US); David S. Li, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 13/720,568

(22) Filed: Dec. 19, 2012

(65) Prior Publication Data

US 2013/0180306 A1 Jul. 18, 2013

Related U.S. Application Data

(63) Continuation of application No. 13/158,018, filed on Jun. 10, 2011, now Pat. No. 8,356,663, which is a continuation of application No. 12/250,080, filed on Oct. 13, 2008, now Pat. No. 7,980,302.

(51) Int. Cl.
*E21B 43/10* (2006.01)
*B21D 31/04* (2006.01)

(52) U.S. Cl.
CPC ..... *B21D 31/04* (2013.01); *E21B 43/105* (2013.01)

(58) Field of Classification Search
CPC ..... E21B 43/103; E21B 43/105; B21D 31/04
USPC ..... 166/277, 207, 206; 72/370.01, 370.08
See application file for complete search history.

(56) References Cited

U.S. PATENT DOCUMENTS

| | | | | |
|---|---|---|---|---|
| 6,352,112 | B1 * | 3/2002 | Mills | 166/277 |
| 6,722,427 | B2 | 4/2004 | Gano et al. | |
| 7,144,243 | B2 | 12/2006 | Stephenson et al. | |
| 7,546,881 | B2 * | 6/2009 | Lloyd et al. | 166/380 |
| 2003/0047323 | A1 | 3/2003 | Jackson et al. | |
| 2005/0194127 | A1 * | 9/2005 | Campo | 166/207 |
| 2006/0076147 | A1 * | 4/2006 | Ring | 166/380 |
| 2006/0124295 | A1 * | 6/2006 | Maguire | 166/207 |
| 2007/0039161 | A1 | 2/2007 | Garcia | |
| 2007/0193736 | A1 * | 8/2007 | Corre et al. | 166/187 |

FOREIGN PATENT DOCUMENTS

WO 2007/017355 A1 2/2007

OTHER PUBLICATIONS

Canadian Office Action; Canadian Patent Application No. 2,682,426; Mailed Jan. 2, 2013.
Austrailian Exam Report for Patent Application No. 2012211360, dated Aug. 18, 2014.

* cited by examiner

*Primary Examiner* — Brad Harcourt
(74) *Attorney, Agent, or Firm* — Patterson & Sheridan, L.L.P.

(57) ABSTRACT

The present invention generally relates to a swage assembly that is movable from a compliant configuration having a first shape to a substantially non-compliant configuration having a second shape. In one aspect, an expansion swage for expanding a wellbore tubular is provided. The expansion swage includes a body and a solid cone disposed on the body. The expansion swage further includes a deformable cone disposed on the body, wherein the solid cone is made from a first material and the deformable cone is made from a second material and wherein the deformable cone is movable relative to the body when the expansion swage is in a compliant configuration. In another aspect, a method of expanding a wellbore tubular is provided.

15 Claims, 12 Drawing Sheets

COMPLIANT EXPANSION SWAGE

CROSS-REFERENCE TO RELATED APPLICATIONS

This application is a continuation of U.S. patent application Ser. No. 13/158,018, filed Jun. 10, 2011, which is a continuation of U.S. patent application Ser. No. 12/250,080, filed Oct. 13, 2008, now U.S. Pat. No. 7,980,302, which applications are herein incorporated by reference in their entirety.

BACKGROUND OF THE INVENTION

1. Field of the Invention

Embodiments of the invention generally relate to apparatus and methods for expanding a tubular in a wellbore. More particularly, embodiments of the invention relate to a compliant expansion swage.

2. Description of the Related Art

Hydrocarbon wells are typically initially formed by drilling a borehole from the earth's surface through subterranean formations to a selected depth in order to intersect one or more hydrocarbon bearing formations. Steel casing lines the borehole, and an annular area between the casing and the borehole is filled with cement to further support and form the wellbore. Several known procedures during completion of the wellbore utilize some type of tubular that is expanded downhole, in situ. For example, a tubular can hang from a string of casing by expanding a portion of the tubular into frictional contact with a lower portion of the casing therearound. Additional applications for the expansion of downhole tubulars include expandable open-hole or cased-hole patches, expandable liners for mono-bore wells, expandable sand screens and expandable seats.

Various expansion devices exist in order to expand these tubulars downhole. Typically, expansion operations include pushing or pulling a fixed diameter cone through the tubular in order to expand the tubular to a larger diameter based on a fixed maximum diameter of the cone. However, the fixed diameter cone provides no flexibility in the radially inward direction to allow for variations in the internal diameter of the casing. For instance, due to tolerances, the internal diameter of the casing may vary by 0.25" or more, depending on the size of the casing. This variation in the internal diameter of the casing can cause the fixed diameter cone to become stuck in the wellbore, if the variation is on the low side. A stuck fixed diameter cone creates a major, time consuming and costly problem that can necessitate a sidetrack of the wellbore since the solid cone cannot be retrieved from the well and the cone is too hard to mill up. Further, this variation in the internal diameter of the casing can also cause an inadequate expansion of the tubular in the casing if the variation is on the high side, which may result in an inadequate coupling between the tubular and the casing.

Thus, there exists a need for an improved compliant cone capable of expanding a tubular while compensating for variations in the internal diameter of the casing.

SUMMARY OF THE INVENTION

The present invention generally relates to a swage assembly. In one aspect, an expansion swage for expanding a wellbore tubular is provided. The expansion swage includes a body. The expansion swage further includes a substantially solid deformable cone disposed on the body, wherein the deformable cone is movable from a first compliant configuration to a second substantially non-compliant configuration and whereby in the first compliant configuration the deformable cone is movable between an original shape and a contracted shape.

In another aspect, a method of expanding a wellbore tubular is provided. The method includes the step of positioning a substantially solid deformable cone in the wellbore tubular. The method further includes the step of expanding a portion of the wellbore tubular by utilizing the deformable cone in a first configuration. The method also includes the step of encountering a restriction to expansion which causes the deformable cone to plastically deform and change into a second configuration. Additionally, the method includes the step of expanding another portion of the wellbore tubular by utilizing the deformable cone in the second configuration.

In yet a further aspect, an expansion swage for expanding a tubular is provided. The expansion swage includes a solid deformable one-piece cone movable between a first shape and a second shape when the expansion swage is in a first configuration. Additionally, the expansion swage includes a plurality of fingers disposed adjacent the deformable one-piece cone portion, wherein the plurality of fingers are configured to allow the movement of the one-piece deformable cone portion between the first shape and the second shape.

In a further aspect, an expansion swage for expanding a tubular is provided. The expansion swage includes a mandrel and a resilient member disposed on the mandrel. The expansion swage further includes a plurality of cone segments disposed around the resilient member, wherein each pair of cone segments is separated by a gap and each cone segment is movable between an expanded position and a retracted position.

Additionally, in another aspect, an expansion swage for expanding a tubular is provided. The expansion swage includes a mandrel, an elastomeric element disposed around the mandrel. The expansion swage further includes a shroud and a composite layer disposed between the shroud and the elastomeric material, wherein the expansion swage is movable between an expanded position and a retracted position.

In yet another aspect, an expansion swage for expanding a tubular is provided. The expansion swage includes a body. The expansion swage also includes a substantially solid deformable cone disposed on the body, wherein the deformable cone is movable from a first configuration to a second configuration upon plastic deformation of the solid deformable cone and whereby in the first configuration the deformable cone is movable between an original shape and a contracted shape.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a swage assembly having a cone portion capable of deflecting in response to a restriction or obstruction encountered while expanding a tubular. While in the following description the tubular is illustrated as a liner, the tubular can be any type of downhole tubular. For example, the tubular may be an open-hole patch, a cased-hole patch or an expandable sand screen. To better understand the aspects of the swage assembly of the present invention and the methods of use thereof, reference is hereafter made to the accompanying drawings.

Figure 1:
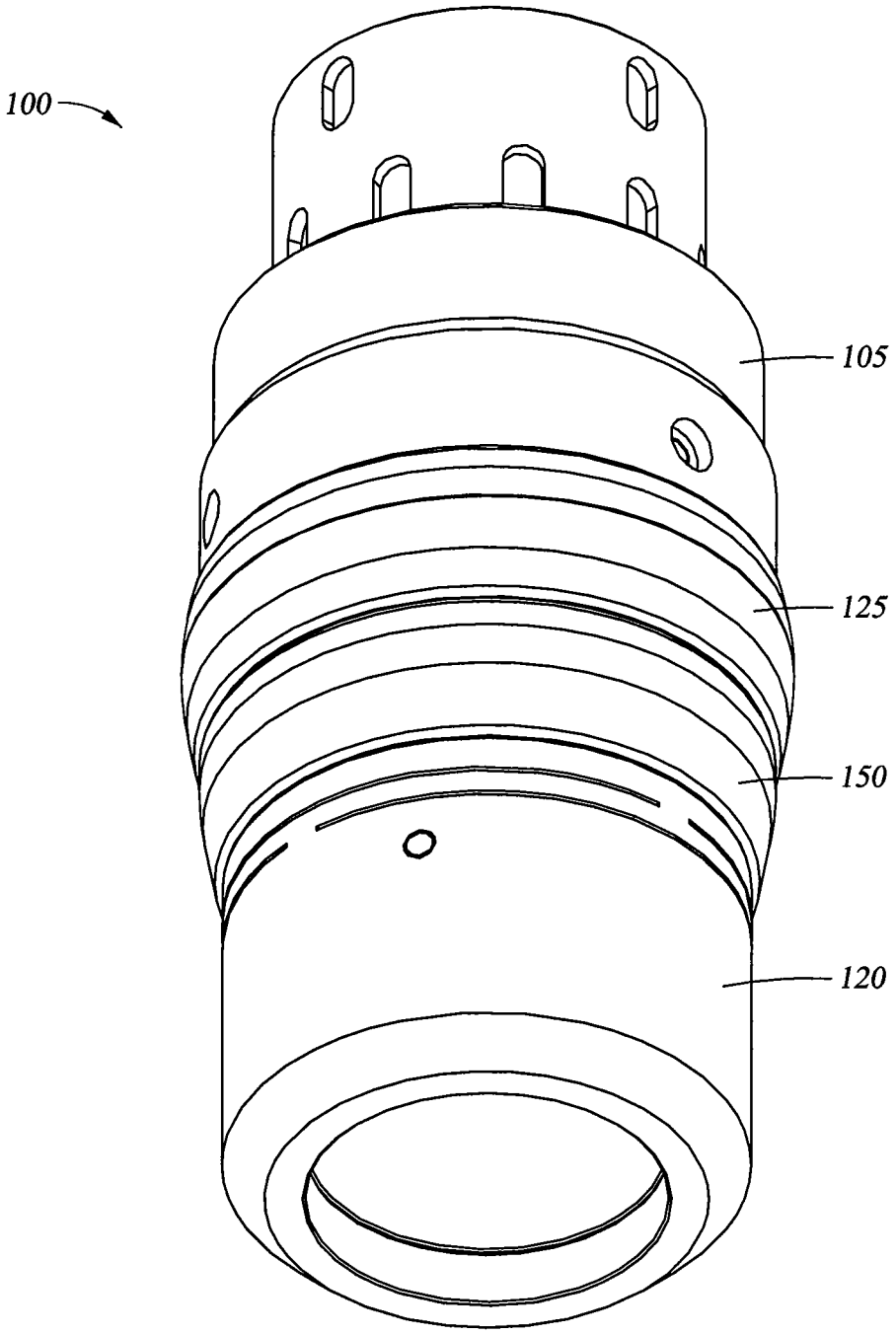
FIG. 1 is an isometric view of a swage assembly according to one embodiment of the invention.

FIG. 1 is an isometric view of a swage assembly 100 according to one embodiment of the invention. The swage assembly 100 is configured to expand a tubular in the wellbore. The swage assembly 100 generally includes a substantially solid deformable cone 125. As will be described herein, the swage assembly 100 may be moved from a first configuration where the swage assembly 100 has a substantially compliant manner to a second configuration where the swage assembly 100 has a substantially non-compliant manner.

Figure 2:
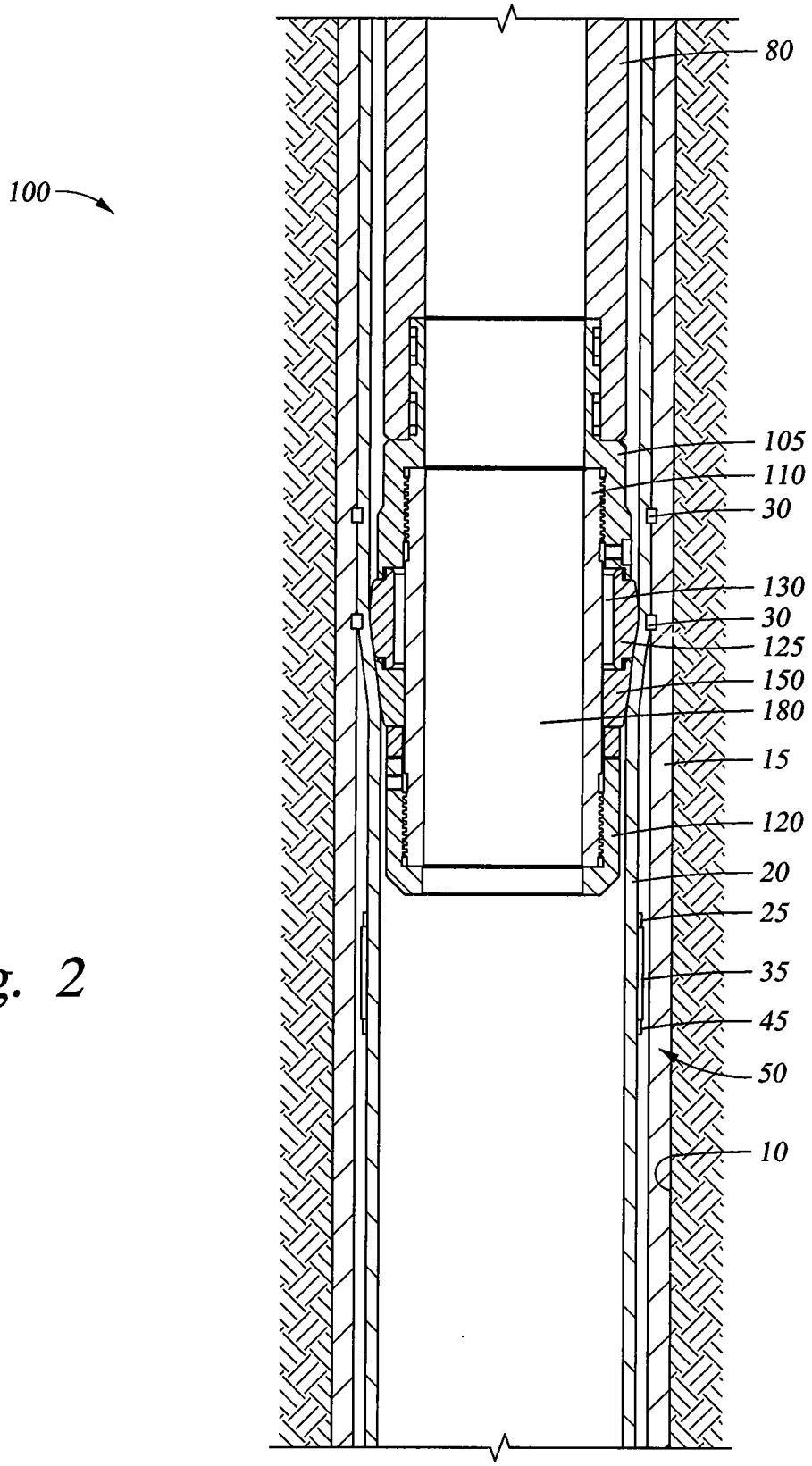
FIG. 2 is a view illustrating the swage assembly in a first shape as the swage assembly expands a tubular in a wellbore.

FIG. 2 is a view illustrating the swage assembly 100 expanding a tubular 20 in a wellbore 10. As shown, the tubular 20 is disposed in a casing 15 which lines the wellbore 10. The tubular 20 may include a restriction to expansion that may cause the swage assembly 100 to move from the first configuration to the second configuration. It should be noted if the force required to expand the tubular 20 proximate the restriction is greater than the force required to urge the material of deformable cone 125 past its yield point then the material of the deformable cone 125 will plastically deform and the swage assembly 100 will move from the first configuration to the second configuration. In one embodiment, the restriction may be a protrusion on an outer surface of the tubular 20 such as a plurality of inserts 30. In another embodiment, the restriction may be a seal assembly 50 comprising a seal member 35, such as an elastomer, a first ring member 25 and a second ring member 45. In a further embodiment, the restriction may be a setting ring member disposed around the tubular 20. In yet a further embodiment, the restriction may be due to irregularities (e.g. non-circular cross-section) in the tubular 20 and/or the casing 15. It should be noted the restriction is not limited to these examples but rather the restriction may be any type of restriction. Further, the restriction may be on the tubular 20, on the casing 15 or in the annulus between the tubular 20 and the casing 15.

As illustrated in FIG. 2, the swage assembly 100 includes a first sleeve 120 attached to the body 110. The first sleeve 120 is used to guide the swage assembly 100 through the tubular 20. The first sleeve 120 has an opening at a lower end to allow fluid or other material to be pumped through a bore 180 of the swage assembly 100. In another embodiment, the sleeve 120 is attached to a work string and the swage assembly 100 is urged upward in the tubular 20 in a bottom-top expansion operation.

The swage assembly 100 also includes a second sleeve 105. The second sleeve 105 is used to connect the swage assembly 100 to a workstring 80 which is used to position the swage assembly 100 in the wellbore 10. In one embodiment, the tubular 20 and the swage assembly 100 are positioned in the wellbore 10 at the same time via the workstring 80. In another embodiment, the tubular 20 and the swage assembly 100 are positioned in the wellbore separately. The second sleeve 105 is connected to a body 110 of the swage assembly 100. Generally, the body 110 is used to interconnect all the components of the swage assembly 100.

The solid deformable cone 125 is disposed in a cavity 130 defined by the second sleeve 105, a body 110 and a non-deformable cone 150. The cross-section of the solid deformable cone 125 is configured to allow the solid deformable cone 125 to move within the cavity 130. For instance, when the swage assembly 100 is in the first configuration, the solid deformable cone 125 is generally movable within the cavity 130 as the swage assembly 100 is urged through the tubular 20. When the swage assembly 100 is in the second configuration, the solid deformable cone 125 generally remains substantially stationary within the cavity 130 as the swage assembly 100 is urged through the tubular 20. The position of the solid deformable cone 125 in the cavity 130 relates to the shape of the swage assembly 100. Additionally, after the swage assembly 100 is removed from the wellbore 10, the solid deformable cone 125 may be removed and replaced with another solid deformable cone 125 if necessary.

As shown in FIG. 2, the swage assembly 100 also includes the non-deformable cone 150. It is to be noted that the non-deformable cone 150 may be an optional component. Generally, the non-deformable cone 150 may be the portion of the swage assembly 100 that initially contacts and expands the tubular 20 as the swage assembly 100 is urged through the tubular 20. The non-deformable cone 150 is typically made from a material that has a higher yield strength than a material of the solid deformable cone 125. For instance, the non-deformable cone 150 may be made from a material having 150 ksi while the solid deformable cone 125 may be made from a material having 135 ksi. The difference in the yield strength of the material between the non-deformable cone 150 and the solid deformable cone 125 allows the solid deformable cone 125 to collapse inward as a certain radial force is applied to the swage assembly 100. The selection of the material for the solid deformable cone 125 directly relates to the amount of compliancy in the swage assembly 100.

Further, the material may be selected depending on the expansion application. For instance, a material with a high yield strength may be selected when the expansion application requires a small range compliancy or a material with a low yield strength may be selected when the expansion application requires a wider range of compliancy. The amount of compliancy allows the swage assembly 100 to compensate for variations in the internal diameter of the casing 15.

Figure 5:
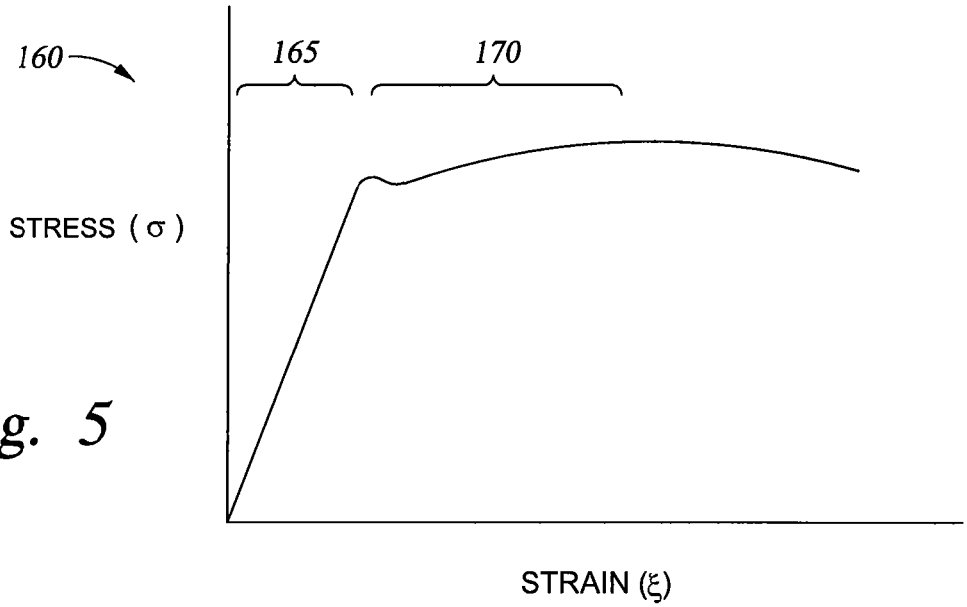
FIG. 5 is a graph illustrating a stress-strain curve.

In FIG. 2, the swage assembly 100 is in the first configuration as the swage assembly 100 expands a portion of the tubular 20 into contact with the surrounding casing 15. With the swage assembly 100 in the first configuration, the solid deformable cone 125 may elastically deform and then spring back to its original shape as the solid deformable cone 125 contacts the tubular 20. For instance, as the solid deformable cone 125 contacts the inner diameter of the tubular 20 proximate a restriction, the solid deformable cone 125 may contract (or move radially inward) into the cavity 130 and then expand (or move radially outward) from the cavity 130 as the swage assembly 100 continues to move and expand the tubular 20. In other words, the solid deformable cone 125 may contract from its original shape and then expand back to its original shape as the material of the solid deformable cone 125 moves in an elastic region 165 below a yield point as illustrated on a graph 160 of FIG. 5. In this configuration, the force acting on the inner diameter of the tubular 20 may vary depending on the position of the solid deformable cone 125 in the cavity 130.

Figure 3:
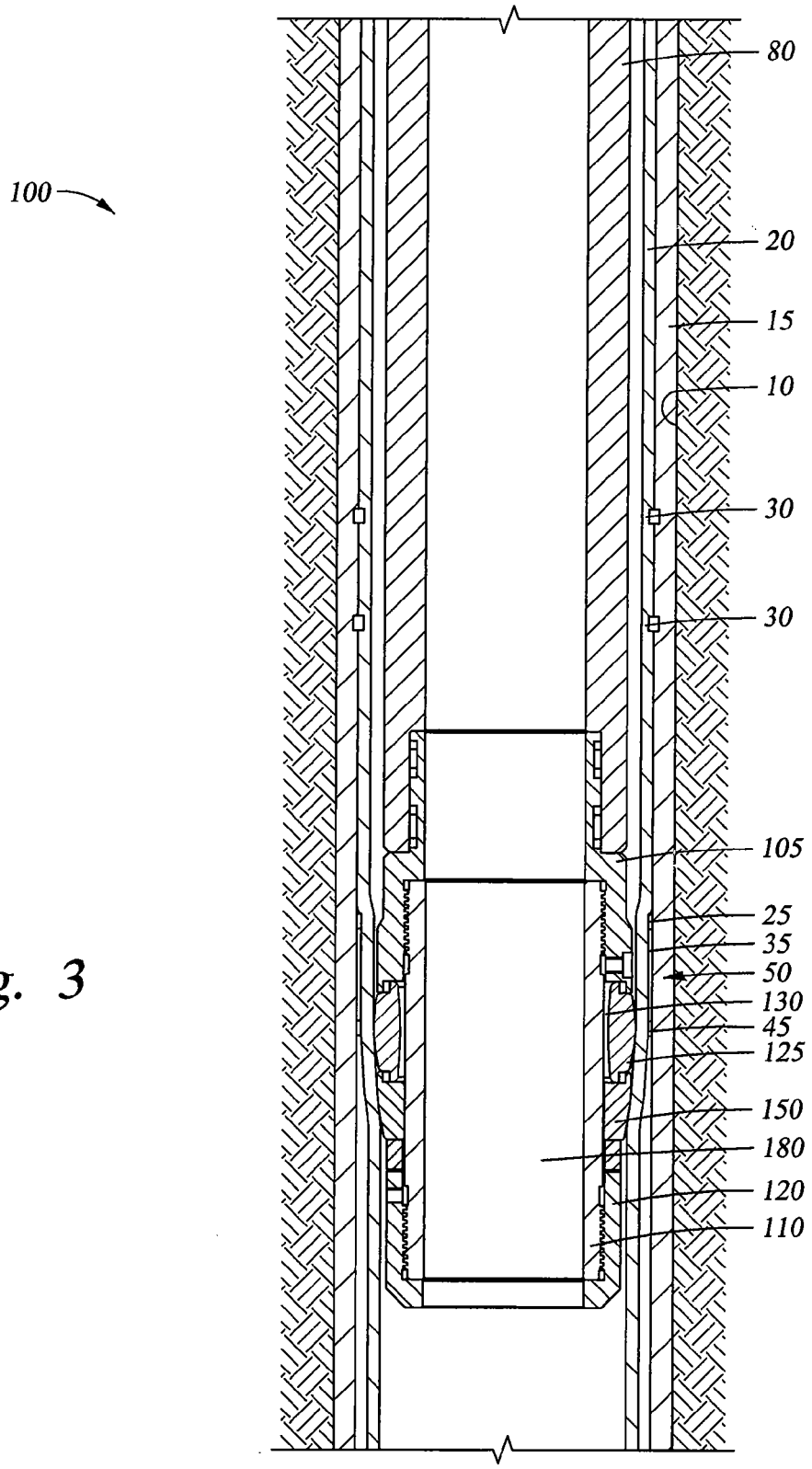
FIG. 3 is a view illustrating the swage assembly in a second shape as the swage assembly expands the tubular.

FIG. 3 is a view illustrating the swage assembly 100 in the second configuration as the swage assembly 100 expands a portion of the tubular 20 into contact with the surrounding casing 15. When the swage assembly 100 is in the second configuration, the solid deformable cone 125 has been plastically deformed and therefore remains substantially stationary within the cavity 130 as the solid deformable cone 125 contacts the tubular 20. To move the swage assembly 100 from the first configuration to the second configuration, the swage assembly 100 expands a portion of the tubular 20 that includes a cross-section (e.g. restriction) that is configured to cause the material of the solid deformable cone 125 to pass a yield point and become plastically deformed. In one embodiment, the restriction in the tubular may be used as a trigger point which causes the swage assembly 100 to move from the first configuration (FIG. 2) to the second configuration (FIG. 3). The expansion of the restriction by the swage assembly 100 causes the material of the solid deformable cone 125 to pass the yield point into a plastic region 170 as shown on a graph 160 in FIG. 5. This causes the solid deformable cone 125 to remain in a contracted configuration relative to its original shape. Referring back to FIG. 3, the solid deformable cone 125 in the second configuration causes the swage assembly 100 to have a reduced diameter shape.

Figure 4:
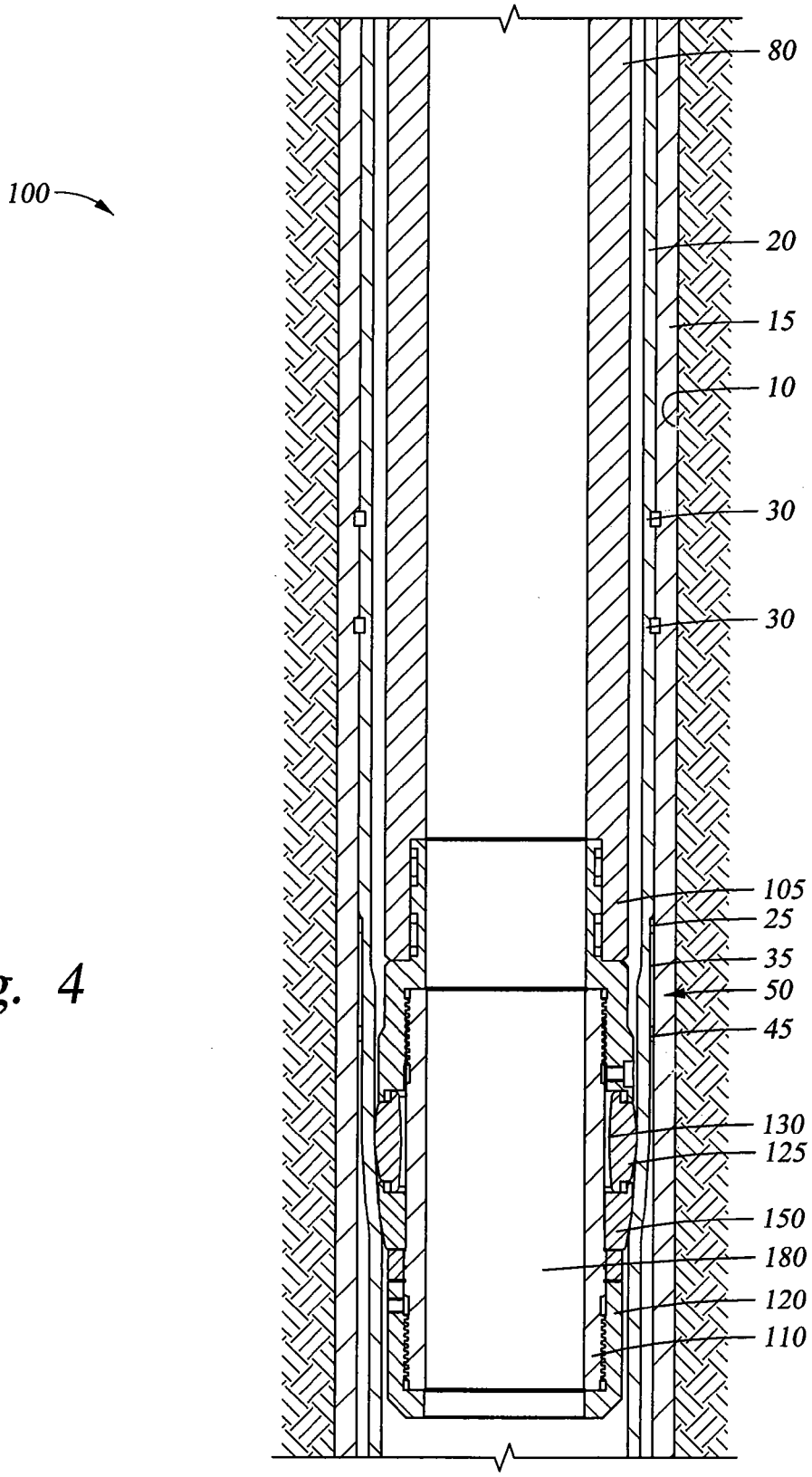
FIG. 4 is a view illustrating the swage assembly expanding another portion of the tubular.

FIG. 4 is a view illustrating the swage assembly 100 expanding another portion of the tubular 20. When the swage assembly 100 is in the second configuration, the swage assembly 100 may still be used to further expand the tubular 20 into contact with the surrounding casing 15. In this configuration, the force from the solid deformable cone 125 acting on the inner diameter of the tubular 20 is substantially constant. In addition to the first configuration and the second configuration, the swage assembly 100 may have a third configuration after the material in the solid deformable cone 125 has plastically deformed. Generally, after the solid deformable cone 125 has plastically deformed, the solid deformable cone 125 still retains a limited range of compliancy. In the third configuration, the material of the deformable cone 125 moves in the plastic region 170 of the graph 160 such that the deformable cone 125 moves between a first diameter (e.g. original outer diameter) and a second smaller diameter. In a similar manner, the swage assembly 100 may have a forth, a fifth, a sixth or more configurations as the material of the deformable cone 125 continues to move in the plastic region 170 of the graph 160 of FIG. 5, wherein each further configuration causes the deformable cone 125 to become less and less compliant. In other words, the deformable cone 125 may be plastically deformed more than once. Further, due to an irregular expansion of the tubular 20, a portion of the deformable cone 125 may plastically deform while another portion of the deformable cone 125 may elastically deform.

In operation, the swage assembly 100 expands the tubular 20 into contact with the surrounding casing 15 by exerting a force on the inner diameter of the tubular 20. The force necessary to expand the tubular 20 may vary during the expansion operation. For instance, if there is a restriction in the wellbore 10, then the force required to expand the tubular 20 proximate the restriction will be greater than if there is no restriction. It should be noted that if the force required to expand the tubular 20 proximate the restriction is less than the force required to urge the material of deformable cone 125 past its yield point then the material of the deformable cone 125 may elastically deform and the swage assembly 100 will expand the tubular 20 in the first configuration. However, if the force required to expand the tubular 20 proximate the restriction is greater than the force required to urge the material of deformable cone 125 past its yield point then the material of the deformable cone 125 may plastically deform and the swage assembly 100 will move from the first configuration to the second configuration. This aspect of the swage assembly 100 allows the swage assembly 100 to change configuration rather than becoming stuck in the tubular 20 or causing damage to other components in the wellbore 10, such the tubular 20, the workstring 80 or the tubular connections. After the swage assembly 100 changes configurations, the swage assembly 100 continues to expand the tubular 20.

Figure 6:
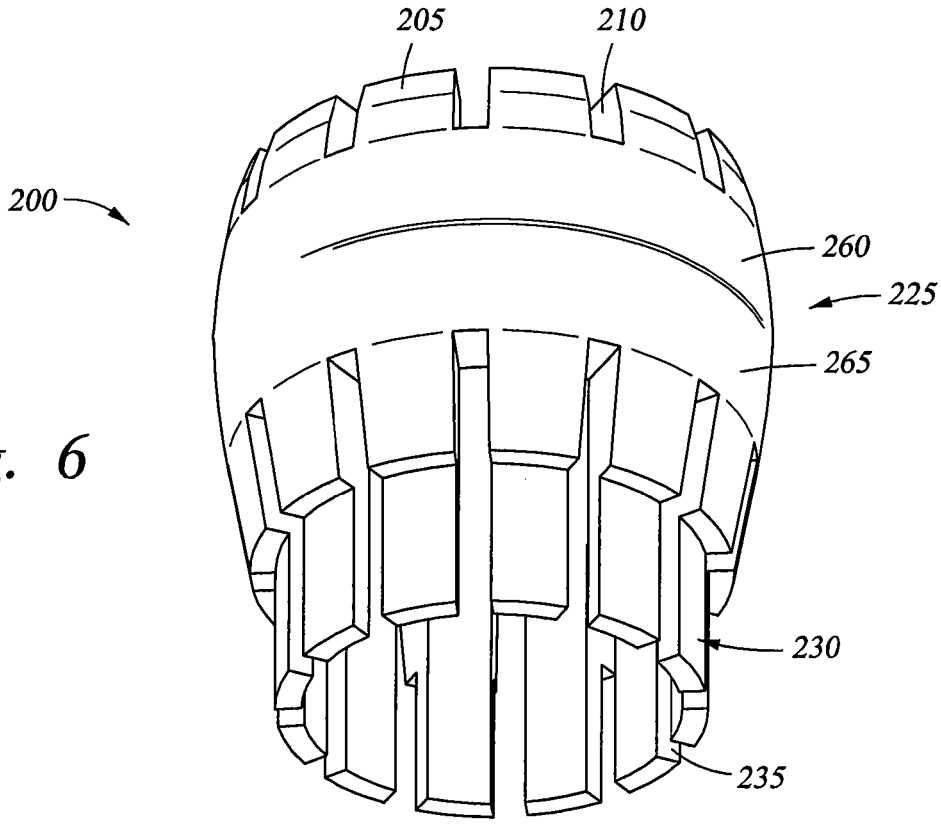
FIG. 6 is an isometric view of a swage assembly according to one embodiment of the invention.

FIG. 6 is an isometric view of a swage assembly 200 according to one embodiment of the invention. The swage assembly 200 is configured to expand a tubular in the wellbore. The swage assembly 200 generally includes a plurality of upper fingers 205 and slots 210, a deformable cone portion 225 and a plurality of lower fingers 230 and slots 235. The swage assembly 200 may be moved from a compliant configuration having a first shape to a substantially non-compliant configuration having a second shape.

As shown in FIG. 6, the deformable cone portion 225 is disposed between the upper fingers 205 and the lower fingers 230. The deformable cone portion 225 may include a first section 260 and a second section 265. Generally, the first section 260 is the part of the swage assembly 200 that initially contacts and expands the tubular as the swage assembly 200 is urged through the tubular. In the embodiment illustrated, the entire deformable cone portion 225 is made from the same material. The selection of the material for the deformable cone portion 225 directly relates to the amount of compliancy in the swage assembly 200. The material may be selected depending on the expansion application. For instance, a material with a higher yield strength may be selected when the expansion application requires a small range compliancy in the swage assembly 200 or a material with a lower yield strength may be selected when the expansion application requires a wider range of compliancy in the swage assembly 200.

In another embodiment, a portion of the deformable cone portion 225 may be made from a first material and another portion of the deformable cone portion 225 is made from a second material. For instance, the first section 260 of the deformable cone portion 225 may be made from a material that has a higher yield strength than a material of the second section 265. The difference in the material yield strength between the first section 260 and the second section 265 allows the second section 265 to collapse radially inward upon application of a certain radial force to the swage assembly 200. In a further embodiment, the deformable cone portion 225 may have layers of different material, wherein each layer has a different yield strength.

In the compliant configuration, the deformable cone portion 225 elastically deforms and moves between an original shape and a collapsed shape as the swage assembly 200 is urged through the tubular. For instance, as the deformable cone portion 225 contacts the inner diameter of the tubular proximate a restriction, the deformable cone portion 225 may contract from the original shape (or move radially inward) and then return to the original shape (or move radially outward) as the swage assembly 200 moves through the tubular. As the deformable cone portion 225 moves between the original shape and the contracted shape, the fingers 205, 230 flex and reduce the size of the slots 210, 235. The swage assembly 200 will remain in the compliant configuration while the material of the deformable cone portion 225 is below its yield point (e.g. elastic region). In this configuration, the force acting on the inner diameter of the tubular may vary due to the compliant nature of the deformable cone portion 225.

In the non-compliant configuration, the deformable cone portion 225 has been plastically deformed and remains substantially rigid as the swage assembly 200 is urged through the tubular. To move the swage assembly 200 from the compliant configuration to the non-compliant configuration, the swage assembly 200 expands a portion of the tubular that includes a cross-section that is configured to cause the material of the deformable cone 225 to pass its yield point. After the material of the deformable cone portion 225 passes its yield point, the deformable cone portion 225 will remain in a shape or size (e.g. collapsed or crushed shape) that is different from its original shape. When the swage assembly 200 is in the substantially non-compliant configuration, the swage assembly 200 may still be used to further expand the tubular into contact with the surrounding casing. In this configuration, the force acting on the inner diameter of the tubular is substantially constant due to the non-compliant nature of the deformable cone portion 225.

Figure 7:
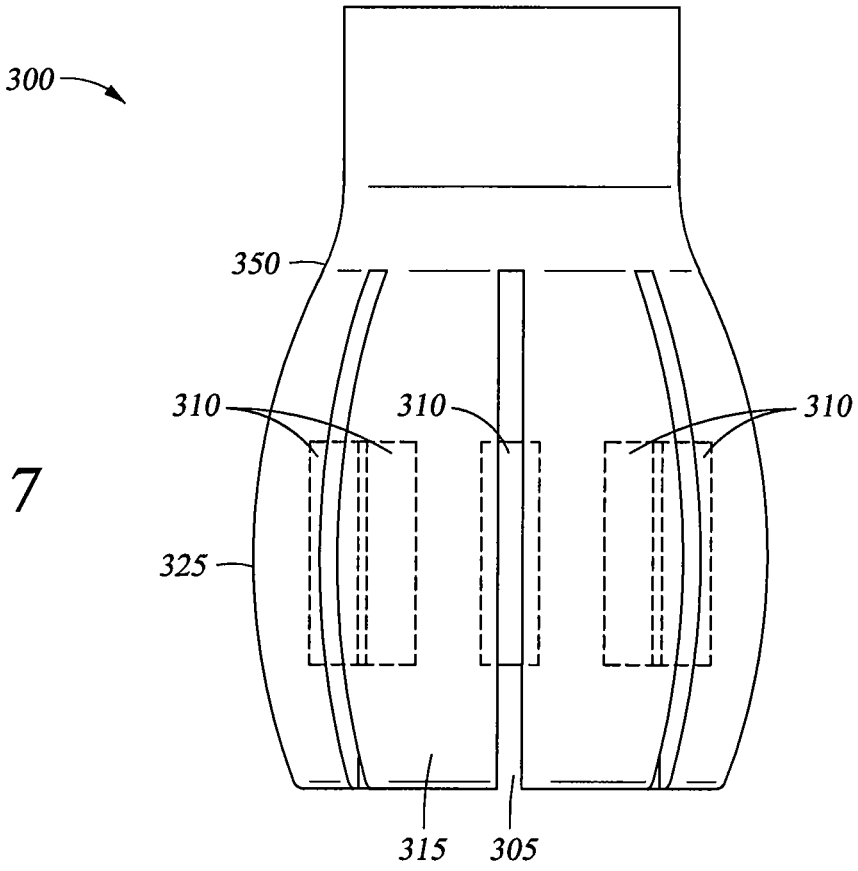
FIG. 7 is a view illustrating a swage assembly according to one embodiment of the invention.
Figure 8:
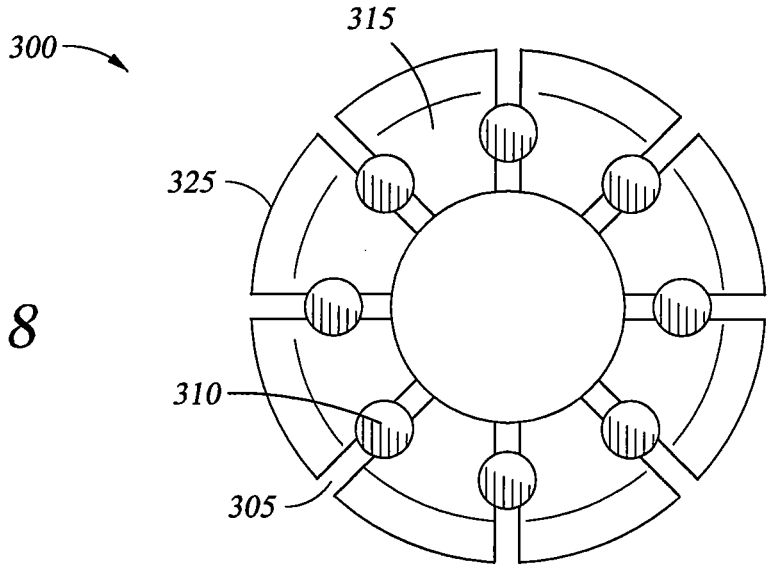
FIG. 8 is a cross-sectional view of the swage assembly in FIG. 7.

FIG. 7 and FIG. 8 are views of a swage assembly 300 according to one embodiment of the invention. The swage assembly 300 is configured to expand a tubular in the wellbore. The swage assembly 300 generally includes a cone portion 325, a plurality of fingers 315 and a plurality of inserts 310 in slots 305 in between the fingers 315. The swage assembly 300 may be moved from a compliant configuration having a first shape to a substantially non-compliant configuration having a second shape.

In the compliant configuration, the cone portion 325 elastically deforms and moves between an original shape and a collapsed shape as the swage assembly 300 is urged through the tubular. For instance, as the cone portion 325 contacts the inner diameter of the tubular proximate the inserts on the tubular (see FIG. 2), the cone portion 325 may move radially inward and then move radially outward (or return to its original shape) as the swage assembly 300 moves through the tubular. As the cone portion 325 moves between the original shape and the contracted shape, the fingers 315 flex which causes the inserts 310 in the slots 305 to react. The inserts 310 are sized and the material of the inserts 310 is selected to provide an elastic response when the applied load is below the yield point of the material and to provide a plastic response when the applied load is above the yield point of the material. In essence, the cone portion 325 will act in a compliant manner while the material of the inserts 310 is below its yield point (e.g. elastic region). Further, in this configuration, the force acting on the inner diameter of the tubular may vary due to the compliant nature of the cone portion 325. Additionally, it should be noted that the inserts 310 are configured to bias the fingers 315 radially outward to allow the cone portion 325 to return to its original shape as the swage assembly 300 moves through the tubular.

The selection of the material for the inserts 310 directly relates to the amount of compliancy in the swage assembly 300. The material may be selected depending on the expansion application. For instance, a material with a higher yield strength may be selected when the expansion application requires a small range compliancy or a material with a lower yield strength may be selected when the expansion application requires a wider range of compliancy. Additionally, the inserts 310 may be secured in the slots 305 by brazing, gluing or any other means known in the art.

In the non-compliant configuration, the cone portion 325 has been plastically deformed and remains substantially rigid as the swage assembly 300 is urged through the tubular. To move the swage assembly 300 from the compliant configuration to the non-compliant configuration, the swage assembly 300 expands a portion of the tubular that includes a cross-section that is configured to cause the material of the inserts 310 to pass its yield point. After the material of the inserts 310 passes the yield point, the cone portion 325 will remain in a configuration that is different (e.g. collapsed shape) from its original shape. When the swage assembly 300 is in the substantially non-compliant configuration, the swage assembly 300 may still be used to further expand the tubular into contact with the surrounding casing. In this configuration, the force from the cone portion 325 acting on the inner diameter of the tubular is substantially constant. In another embodiment, the fingers 315 may separate from the inserts 310 along a bonded portion when the material of the inserts 310 passes its yield point, thereby causing the fingers 315 to have a greater range of movement or flexibility. The flexibility of the fingers 315 allows the swage assembly 300 to become more compliant rather less compliant when the material of inserts 310 is plastically deformed.

Figure 10:
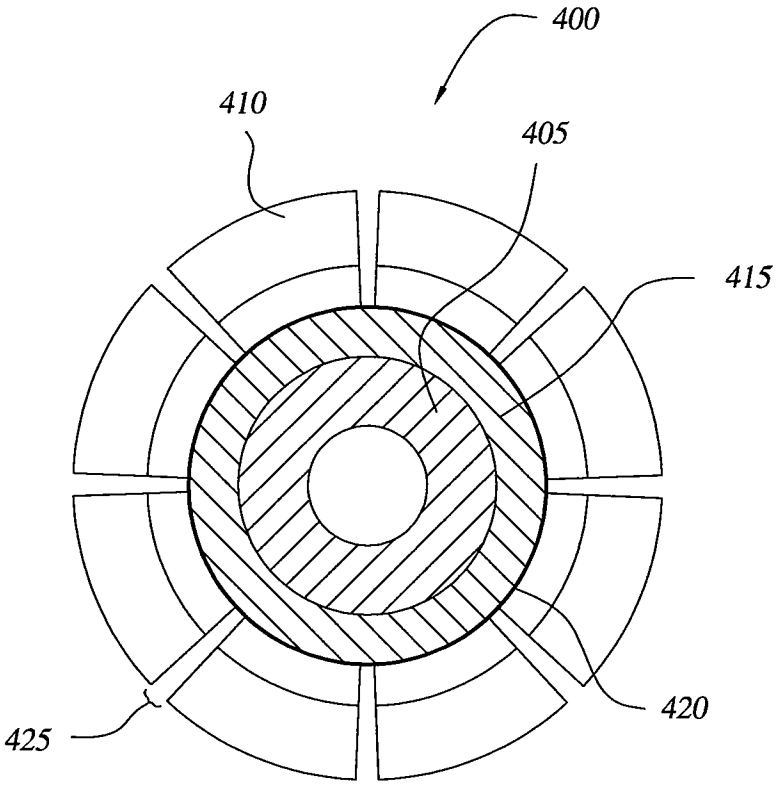
FIG. 10 is a sectional view of the swage assembly in FIG. 9.
Figure 9:
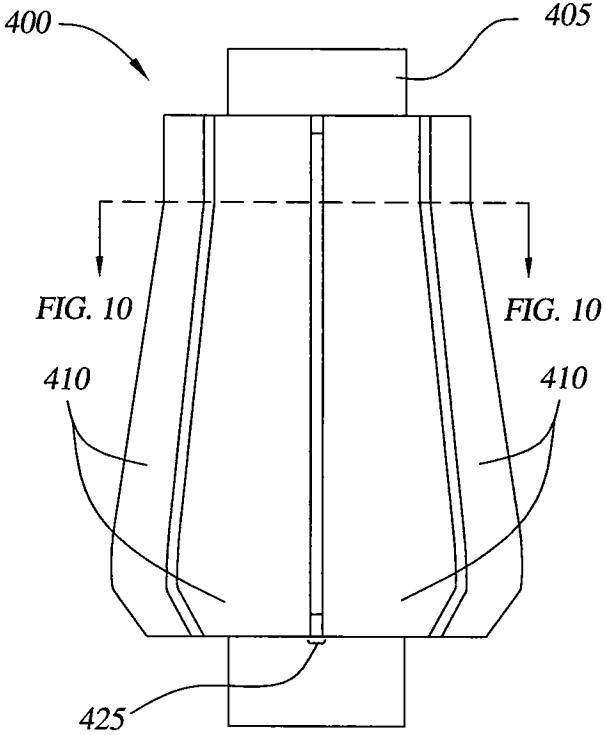
FIG. 9 is a view illustrating a swage assembly according to one embodiment of the invention.

FIG. 9 and FIG. 10 are views of a swage assembly 400 according to one embodiment of the invention. The swage assembly 400 is configured to expand a tubular in the wellbore. The swage assembly 400 generally includes a mandrel 405, a plurality of cone segments 410 and a resilient member 415. As discussed herein, the configuration (e.g. outer diameter) of the swage assembly 400 adjusts as the swage assembly 400 moves through the tubular.

As shown in FIGS. 9 and 10, the resilient member 415 is disposed around the mandrel 405. The resilient member 415 may be bonded to the mandrel 405 by any means known in the art. The resilient member 415 is configured to act as a compliant member. Generally, the resilient member 415 is selected based on compliance range limits. For instance, a rigid material may be selected when the expansion application requires a small range compliancy or a flexible material may be selected when the expansion application requires a wider range of compliancy. As also shown in FIGS. 9 and 10, the plurality of cone segments 410 is disposed on the resilient member 415. Each pair of cone segments 410 is separated by a gap 425.

The swage assembly 400 moves between a first shape (e.g. an original shape) and a second shape (e.g. a contracted shape) as the swage assembly 400 is urged through the tubular. For instance, as the swage assembly 400 contacts an inner diameter of the tubular proximate a restriction, the swage assembly 400 may contract from the original shape (or move radially inward) and then return to the original shape (or move radially outward) as the swage assembly 400 continues to move through the tubular past the restriction. As the swage assembly 400 moves between the original shape and the contracted shape, the cone segments 410 flex inward to reduce the gap 425 which subsequently adjusts the size of the swage assembly 400. The force acting on the inner diameter of the tubular may vary due to the compliant nature of the swage assembly 400. Further, the compliancy of the swage assembly 400 may be controlled by the selection of the resilient member 415. Additionally, in a similar manner as set forth herein, the resilient member 415 may plastically deform if subjected to a stress beyond a threshold value. In one embodiment, a fiber material 420 is disposed between the resilient member 415 and the cone segments 410. The fiber material 420 is configured to restrict the flow (or movement) of the resilient member 415 into the gap 425 as the swage assembly 400 moves between the different sizes.

Figure 12:
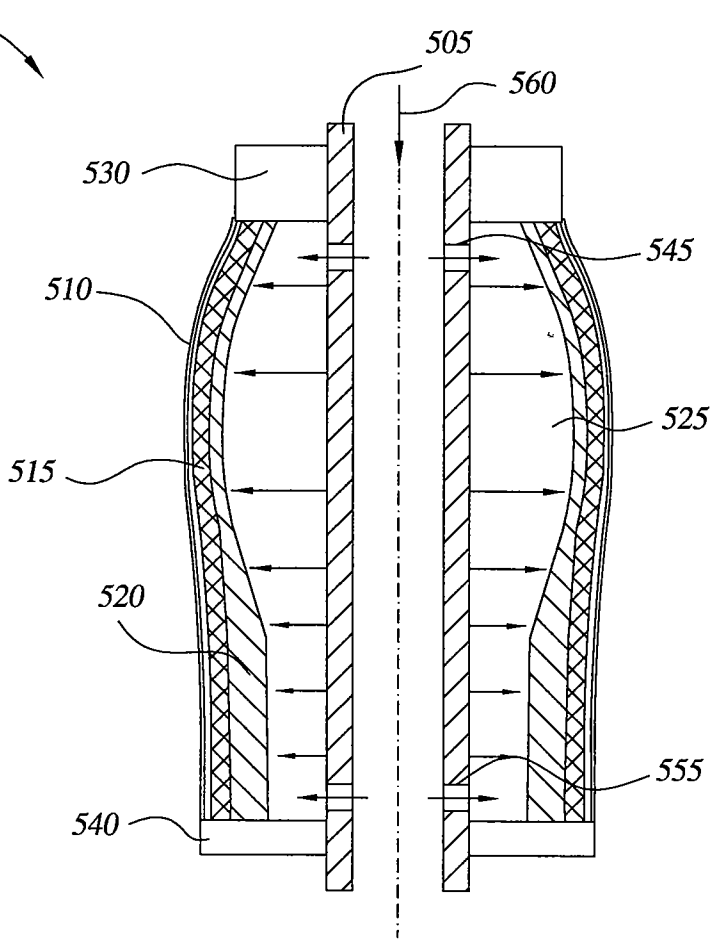
FIG. 12 is a view illustrating the swage assembly of FIG. 11 in an expanded position.
Figure 11:
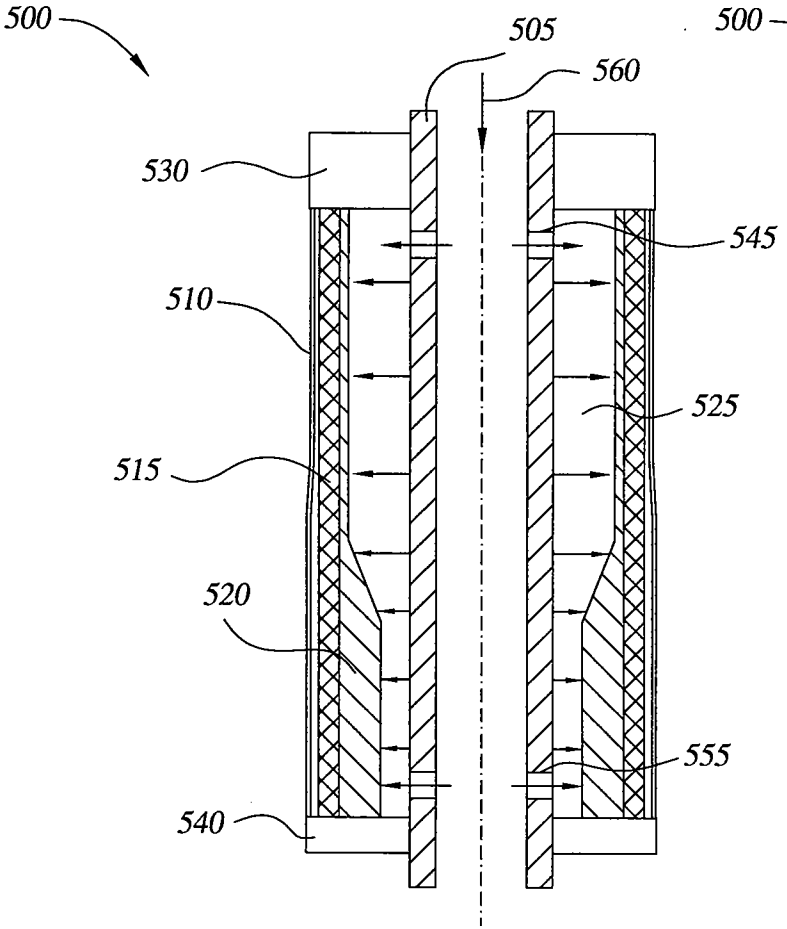
FIG. 11 is a view illustrating a swage assembly according to one embodiment of the invention, wherein the swage assembly is in a collapsed position.

FIG. 11 and FIG. 12 are views of a swage assembly 500 according to one embodiment of the invention. The swage assembly 500 is configured to expand a tubular in the wellbore. The swage assembly 500 generally includes a composite layer 515 disposed between an outer shroud 510 and an inner resilient member 520. The shroud 510 is configured to protect the composite layer 515 from abrasion as the swage assembly 500 moves through the tubular. Further, the swage assembly 500 is configured to move between a collapsed position (FIG. 11) and an expanded position (FIG. 12).

As illustrated in FIG. 11, the shroud 510, the composite layer 515 and the resilient member 520 are disposed around the mandrel 505. Each end of the composite layer 515 is attached to the mandrel 505 via a first support 530 and a second support 540. As also shown in FIG. 11, the swage assembly 500 includes a fluid chamber 525 that is defined between the resilient member 520, the mandrel 505, the first support 530 and the second support 540. Additionally, the composite layer 515 may be made from any type of composite material, such as Zylon and/or Kevlar.

The swage assembly 500 moves between the collapsed position and the expanded position as fluid, represented by arrow 560, is pumped through the mandrel 505 and into the chamber 525 via ports 545, 555. As fluid pressure builds in the chamber 525, the fluid pressure causes the composite layer 515 to move radially outward relative to the mandrel 505 to the expanded position. As the swage assembly 500 is urged through the tubular, the swage assembly 500 compliantly expands the tubular. The force acting on the inner diameter of the tubular may vary due to the compliant nature of the swage assembly 500. Further, the compliancy of the swage assembly 500 may be controlled by metering fluid out of the chamber 525. For instance, as the swage assembly 500 contacts the inner diameter of the tubular proximate a restriction, the swage assembly 500 may contract from the expanded position (or move radially inward) and then return to the expanded position (or move radially outward) as the swage assembly 500 continues to move through the tubular past the restriction. The contraction of the swage assembly 500 causes the internal fluid pressure in the chamber 525 to increase. This increase in fluid pressure may be released by a multi-set rupture disk (not shown) or another metering device. In the embodiment shown in FIG. 12, the swage assembly 500 is configured as a fixed angle swage. In another embodiment, the swage assembly 500 may be configured as a variable angle swage.

Figure 14:
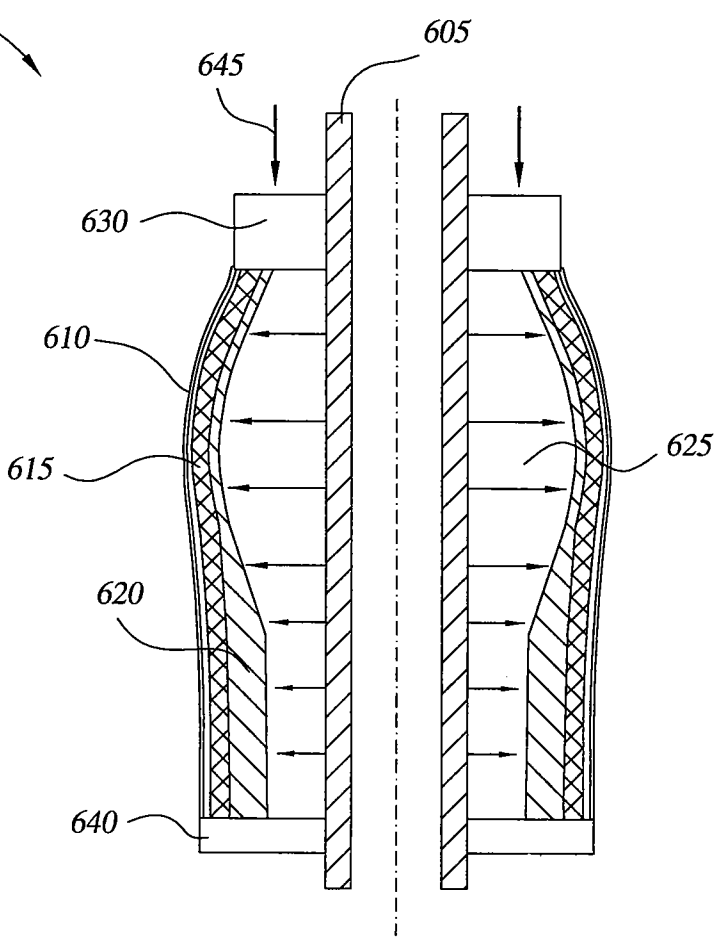
FIG. 14 is a view illustrating the swage assembly of FIG. 13 in an expanded position.
Figure 13:
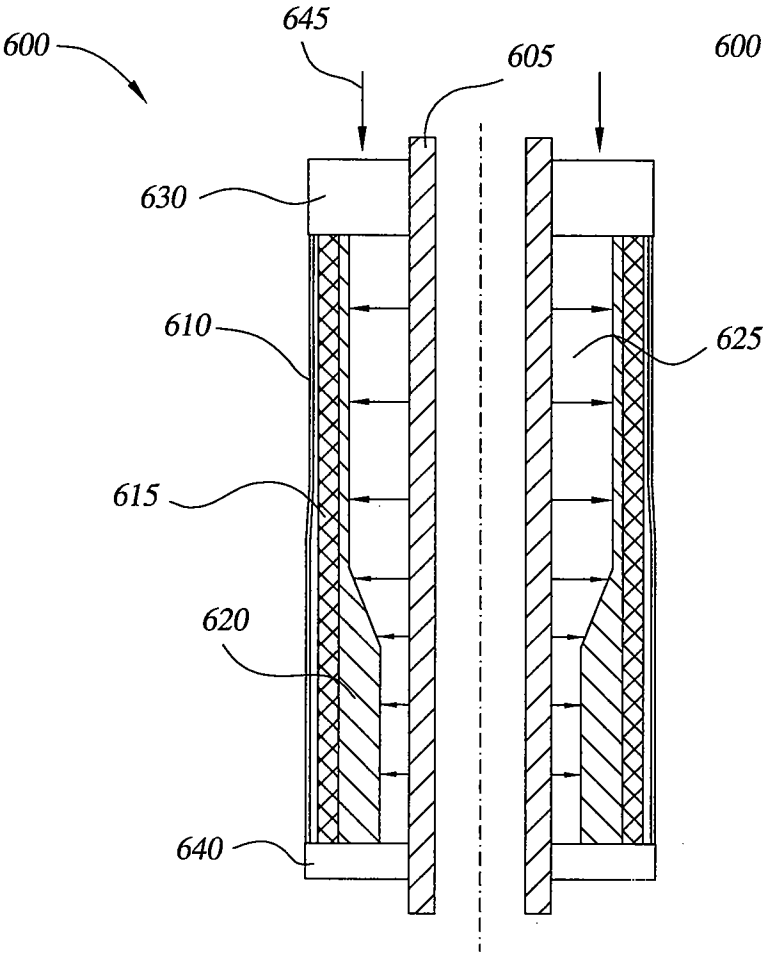
FIG. 13 is a view illustrating a swage assembly according to one embodiment of the invention, wherein the swage assembly is in a collapsed position.

FIG. 13 and FIG. 14 are views of a swage assembly 600 according to one embodiment of the invention. The swage assembly 600 generally includes a composite layer 615 disposed between an outer shroud 610 and an inner resilient member 620. The swage assembly 600 is configured to move between a collapsed position (FIG. 13) and an expanded position (FIG. 14).

As illustrated in FIG. 13, the swage assembly 600 includes a chamber 625 that is defined between the resilient member 620, the mandrel 620, a first support 630 and a second support 640. The chamber 625 typically includes a fluid, such as a liquid and/or gas. The swage assembly 600 moves between the collapsed position and the expanded position as a force 645 acts on the first support 630. The force 645 causes the support member 630 to move axially along the mandrel 605 toward the second support 640 which is fixed to the mandrel 605. The movement of the support member 630 pressurizes the fluid in the chamber 625. As fluid pressure builds in the chamber 625, the fluid pressure causes the composite layer 615 to move radially outward relative to the mandrel 605 to the expanded position.

As the swage assembly 600 is urged through the tubular, the swage assembly 600 expands the tubular in a compliant manner. The compliancy of the swage assembly 600 may be controlled by adjusting the force 645 applied to the first support 630. In other words, as the force 645 is increased, the pressure in the chamber 625 is increased which reduces the compliancy of the swage assembly 600. In contrast, as the force 645 is decreased, the pressure in the chamber 625 is decreased which increases the compliancy of the swage assembly 600. This aspect may be important when the swage assembly 600 contacts an inner diameter of the tubular proximate a restriction, the swage assembly 600 may contract from the expanded position (or move radially inward) and then return to the expanded position (or move radially outward) as the swage assembly 600 moves through the tubular past the restriction. The contraction of the swage assembly 600 causes the internal fluid pressure in the chamber 625 to increase. This increase in fluid pressure may be controlled by reducing the force 645 applied to the first support 630 and allowing the first support 630 to move axially away from the second support 640. In another embodiment, the second support 640 may be configured to move relative to first support 630 in order to pressurize the chamber 625. In a further embodiment, both the first support 630 and the second support 640 may move along the mandrel 605 in order to pressurize the chamber 625.

Figure 16:
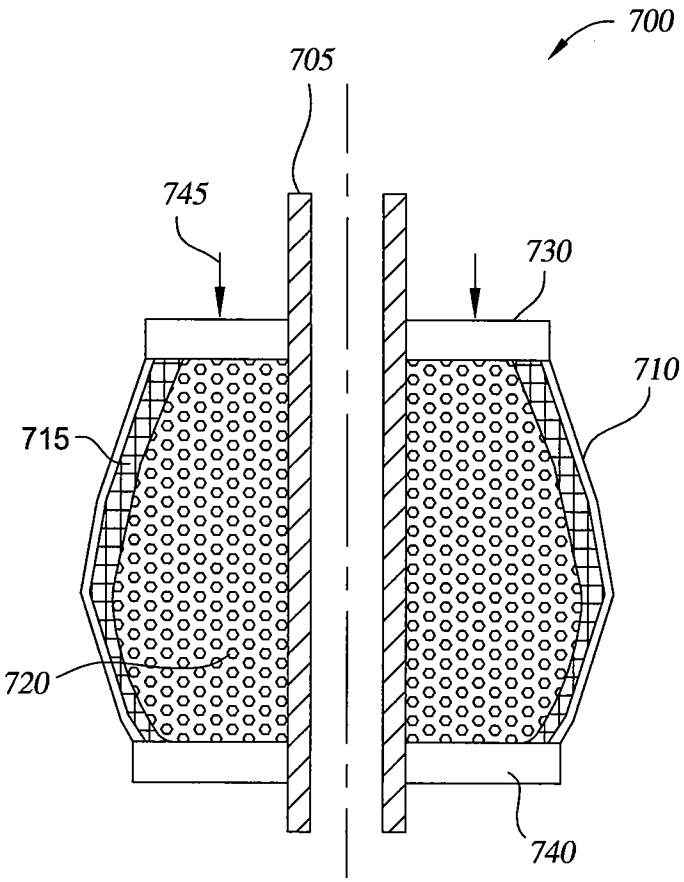
FIG. 16 is a view illustrating the swage assembly of FIG. 15 in an expanded position.
Figure 15:
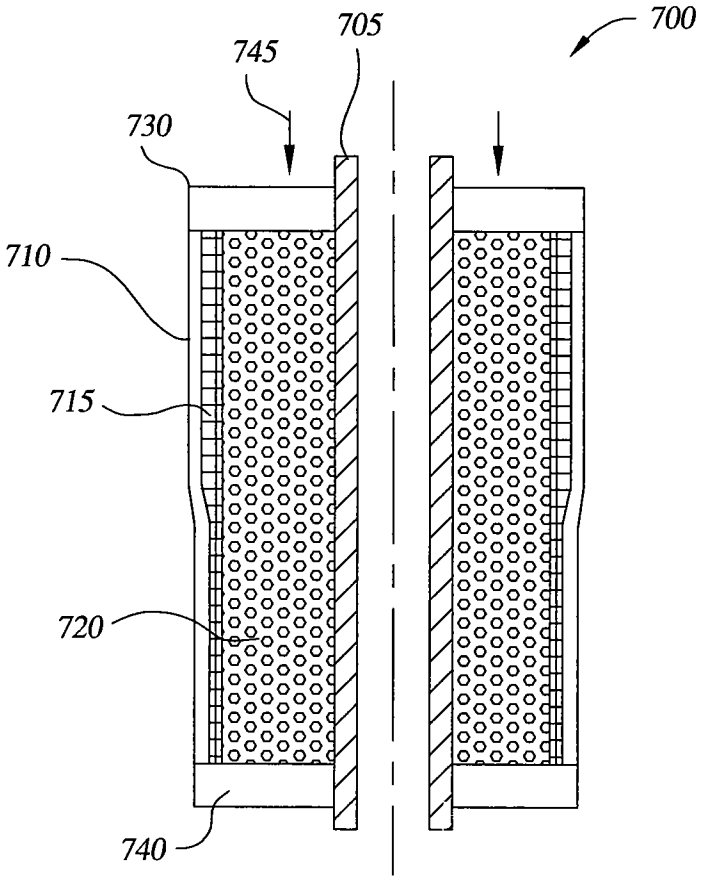
FIG. 15 is a view illustrating a swage assembly according to one embodiment of the invention, wherein the swage assembly is in a collapsed position.

FIG. 15 and FIG. 16 are views of a swage assembly 700 according to one embodiment of the invention. The swage assembly 700 generally includes a composite layer 715 disposed between an outer shroud 710 and an elastomer 720. The swage assembly 700 is configured to move between a collapsed position and an expanded position as shown in FIGS. 15 and 16, respectively.

The swage assembly 700 moves between the collapsed position and the expanded position as a force 745 acts on the first support 730. The force 745 causes the support member 730 to move axially along the mandrel 705 toward the second support 740 which is fixed to the mandrel 705. The movement of the support member 730 compresses the elastomer 720. As the elastomer 720 is compressed, the elastomer 720 is reshaped which causes the swage assembly 700 to move radially outward relative to the mandrel 705 to the expanded position.

As the swage assembly 700 is urged through the tubular, the swage assembly 700 expands the tubular in a compliant manner. The compliancy of the swage assembly 700 may be controlled by the selection of the elastomer 720. For instance, a rigid material may be selected when the expansion application requires a small range compliancy or a flexible material may be selected when the expansion application requires a wider range of compliancy. The amount of expansion of the swage assembly 700 may be controlled by adjusting the force 745 applied to the first support 730. In other words, as the force 745 is increased, the pressure on the elastomer 720 is increased which causes the composite layer 715 to expand radially outward relative to the mandrel 705. In contrast, as the force 745 is decreased, the pressure on the elastomer 720 is decreased which causes the composite layer 715 to contract radially inward. This aspect may be important when the swage assembly 700 contacts the inner diameter of the tubular proximate a restriction. In this situation, the swage assembly 700 may contract from the expanded position (or move radially inward) and then return to the expanded position (or move radially outward) as the swage assembly 700 moves through the tubular past the restriction. The contraction of the swage assembly 700 causes the elastomer 720 to be reshaped. In another embodiment, the second support 740 may be configured to move relative to first support 730 in order to reshape the swage assembly 700. In a further embodiment, both the first support 730 and the second support 740 may move along the mandrel 705 in order to reshape the swage assembly 700.

Figure 17B:
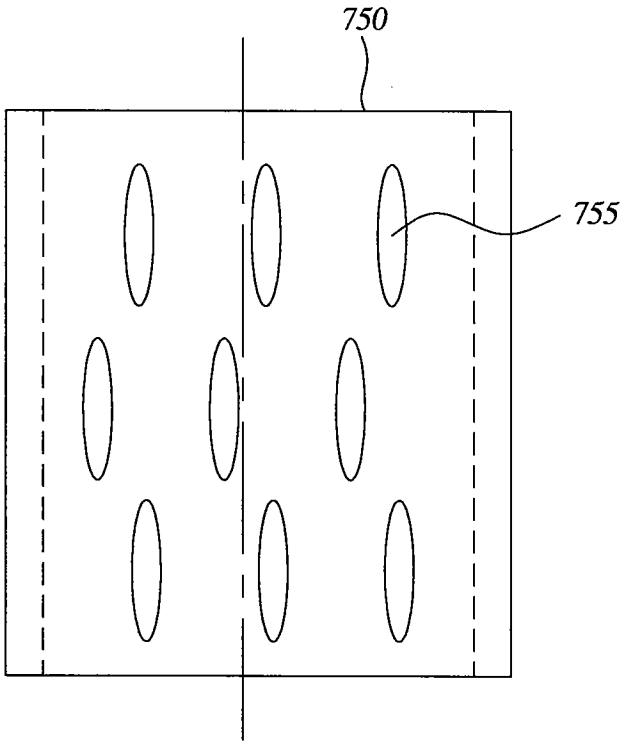
FIGS. 17A and 17B are views illustrating a shroud for use with a swage assembly.
Figure 17A:
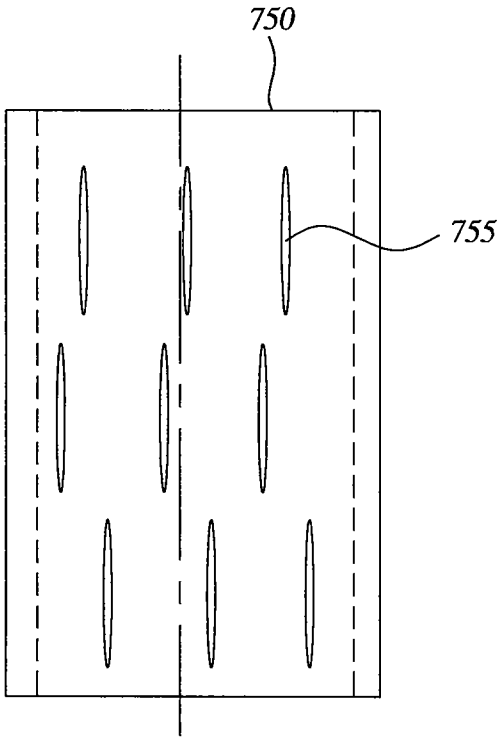

FIGS. 17A and 17B are views illustrating a shroud 750 for use with the swage assembly 500, 600 or 700. Generally, the shroud 750 is configured to protect the composite layer from abrasion as the swage assembly moves through the tubular. In the embodiment shown, the shroud 750 includes a plurality of openings 755 that allows the shroud 750 to expand (FIG. 17B) or contract (FIG. 17A) as the swage assembly expands or contracts.

Figure 18:
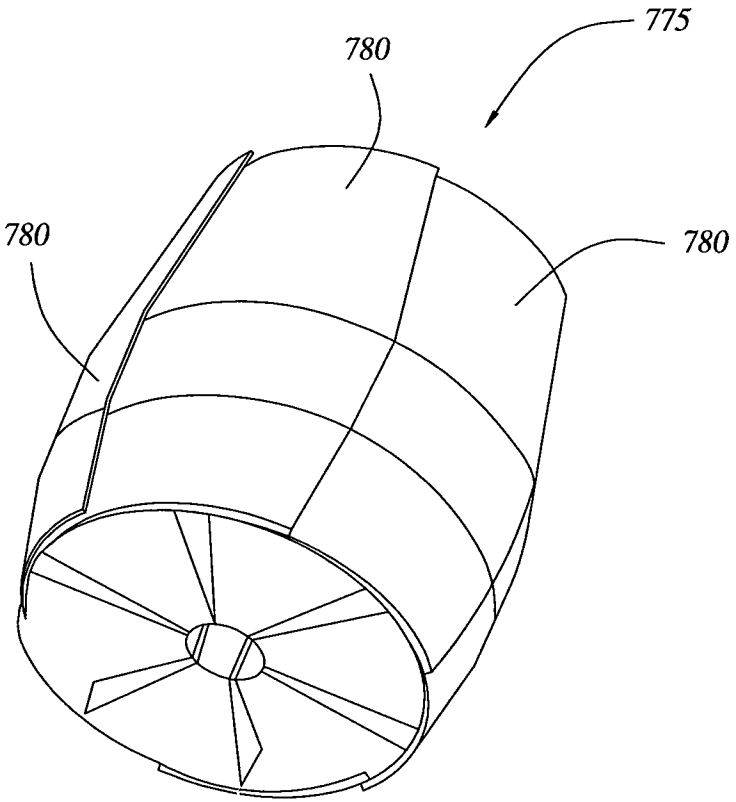
FIG. 18 is a view illustrating a shroud for use with a swage assembly.

FIG. 18 is a view illustrating a shroud 775 for use with the swage assembly 500, 600 or 700. The shroud 775 is configured to protect the composite layer from abrasion as the swage assembly moves through the tubular. The shroud 775 includes a plurality of overlapping slats 780. As the swage assembly expands or contracts, the overlapping slats 780 move relative to each other.

For some embodiments, the swage assembly 100, 200, 300, 400, 500, 600 or 700 may be oriented or flipped upside down such that expansion occurs in a bottom-top direction. In operation, a pull force, instead of the push force, is applied to the swage assembly to move the swage assembly through the tubular that is to be expanded. The cone portion can still flex upon encountering a restriction as described herein.

While the foregoing is directed to embodiments of the present invention, other and further embodiments of the invention may be devised without departing from the basic scope thereof, and the scope thereof is determined by the claims that follow.

The invention claimed is:

1. An expansion swage for expanding a tubular, comprising:

an inner mandrel;

a compliant member coupled to the inner mandrel; and a plurality of cone segments coupled to the compliant member, wherein the cone segments are configured to expand the tubular, wherein adjacent cone segments are separated by a gap that extends along a longitudinal length of the adjacent cone segments such that each end of each cone segment is separate from each end of each adjacent cone segment, wherein the compliant member is positioned between the inner mandrel and the cone segments, wherein the compliant member is configured to move the cone segments radially outward from a contracted position to an original position, and wherein the compliant member is configured to plastically deform in response to contact by the cone segments with the interior of the tubular when subjected to a stress above a threshold value.

2. The expansion swage of claim 1, further comprising a fiber material disposed between the compliant member and the cone segments.

3. The expansion swage of claim 2, wherein the fiber material is configured to prevent flow of the compliant member into the gap between adjacent cone segments when moved to the contracted position.

4. The expansion swage of claim 3, wherein the cone segments are disposed on the outer surface of the fiber material.

5. The expansion swage of claim 1, wherein the cone segments are movable radially inward toward the inner mandrel to the contracted position.

6. The expansion swage of claim 1, wherein the cone segments are movable radially outward away from the inner mandrel to the original position.

7. The expansion swage of claim 1, wherein the cone segments are disposed on the outer surface of the compliant member.

8. The expansion swage of claim 1, wherein the compliant member is disposed on the outer surface of the inner mandrel.

9. The expansion swage of claim 1, wherein the compliant member is bonded to the outer surface of the inner mandrel.

10. A method of expanding a tubular, comprising:

moving an expansion swage through the tubular, wherein the expansion swage comprises an inner mandrel, a compliant member, and a plurality of cone segments;

moving the cone segments between an original position and a contracted position, wherein adjacent cone segments are separated by a gap that extends along a longitudinal length of the adjacent cone segments such that each end of each cone segment is separate from each end of each adjacent cone segment, wherein the compliant member is positioned between the inner mandrel and the cone segments, and wherein the compliant member is configured to plastically deform in response to contact by the cone segments with the interior of the tubular when subjected to a stress above a threshold value;

moving the cone segments radially outward from the contracted position to the original position using the compliant member; and expanding the tubular using the cone segments.

11. The method of claim 10, further comprising a fiber material disposed between the compliant member and the cone segments.

12. The method of claim 11, further comprising preventing flow of the compliant member into the gap between adjacent cone segments using the fiber material when moving the cone segments between the original position and the contracted position.

13. The method of claim 10, further comprising moving the cone segments radially inward toward the inner mandrel to the contracted position.

14. The method of claim 10, further comprising moving the cone segments radially outward away from the inner mandrel to the original position.

15. The method of claim 10, further comprising moving the expansion swage through a restriction in the tubular member thereby moving the cone segments to the contracted position.

* * * * *